US008042837B2

(12) United States Patent
Busam et al.

(10) Patent No.: US 8,042,837 B2
(45) Date of Patent: Oct. 25, 2011

(54) SELF-RETAINING SELL TAG FOR A BOUND COMPONENT

(75) Inventors: Edward P. Busam, Mason, OH (US); Lisa K. Brooks, West Chester, OH (US)

(73) Assignee: MeadWestvaco Corporation, Richmond, VA (US)

( * ) Notice: Subject to any disclaimer, the term of this patent is extended or adjusted under 35 U.S.C. 154(b) by 824 days.

(21) Appl. No.: 11/840,472

(22) Filed: Aug. 17, 2007

(65) Prior Publication Data

US 2008/0175692 A1 Jul. 24, 2008

Related U.S. Application Data

(60) Provisional application No. 60/881,811, filed on Jan. 22, 2007.

(51) Int. Cl.

| | |
|---|---|
| ***B42D 15/00*** | (2006.01) |
| ***B42D 1/00*** | (2006.01) |
| ***B42F 13/00*** | (2006.01) |
| ***B42F 21/00*** | (2006.01) |
| ***B65D 27/00*** | (2006.01) |
| ***G09F 3/02*** | (2006.01) |
| ***G09F 3/10*** | (2006.01) |

(52) U.S. Cl. ..... 283/56; 402/79; 281/27.3; 40/359; 40/360; 40/631; 40/672

(58) Field of Classification Search ..... 402/79; 283/36, 56; 40/359, 360, 631, 641, 672; 281/27.1–27.3

See application file for complete search history.

(56) References Cited

U.S. PATENT DOCUMENTS

| | | | | |
|---|---|---|---|---|
| 1,241,049 | A * | 9/1917 | Stevens | 283/36 |
| 1,304,417 | A * | 5/1919 | Underwood | 40/663 |
| 1,843,771 | A * | 2/1932 | Kline | 402/79 |
| 2,051,738 | A * | 8/1936 | Ottinger | 281/27.1 |
| 2,324,777 | A * | 7/1943 | Holmstrom | 40/672 |
| 4,379,372 | A * | 4/1983 | Alexander et al. | 40/645 |
| 4,431,325 | A * | 2/1984 | Colby | 402/79 |
| 4,596,482 | A * | 6/1986 | Salzer | 402/3 |
| 4,795,287 | A * | 1/1989 | Friedman | 402/79 |
| 4,811,973 | A * | 3/1989 | Kumar-Misir | 281/27.2 |
| 5,853,259 | A * | 12/1998 | Murray, Jr. | 283/36 |
| 5,876,145 | A * | 3/1999 | Datum | 402/4 |
| 6,202,335 | B1 | 3/2001 | Shelton et al. | |
| 6,357,797 | B1 * | 3/2002 | Lee | 281/42 |
| 6,634,501 | B2 | 10/2003 | Su et al. | |
| 6,883,423 | B2 * | 4/2005 | Yamamoto et al. | 40/641 |
| 7,077,597 | B2 * | 7/2006 | Davies | 402/79 |

* cited by examiner

*Primary Examiner* — Dana Ross
*Assistant Examiner* — Kyle Grabowski
(74) *Attorney, Agent, or Firm* — MWV Intellectual Property Group

(57) ABSTRACT

A bound component including a cover having an outer perimeter, a plurality of pages, and a binding mechanism binding the cover and the plurality of pages together, wherein the binding mechanism includes a plurality of coils. The bound component further includes a sell tag including at least one opening, the at least one opening receiving at least one coil of the binding mechanism therethrough, wherein the sell tag includes a flap which is folded about part of the outer perimeter of the cover.

21 Claims, 5 Drawing Sheets

SELF-RETAINING SELL TAG FOR A BOUND COMPONENT

This application claims priority to Provisional Application Ser. No. 60/881,811, filed on Jan. 22, 2007, the entire contents of which are hereby incorporated by reference.

The present invention is directed to a self-retaining sell tag, and more particularly, to a self-retaining sell tag for use with a bound component such as a notebook or the like.

BACKGROUND

Sell tags are widely used with notebooks, bound components and the like to provide information relating to the associated bound component or notebook. For example, sell tags may provide information relating to the nature of the bound component, number of pages, types of materials, dimensions, manufacturer information, pricing information, patent, trademark and copyright markings, UPC codes, description of product features, marketing and advertising information, and the like.

SUMMARY

In one embodiment, the present invention is a bound component including a cover having an outer perimeter, a plurality of pages, and a binding mechanism binding the cover and the plurality of pages together, wherein the binding mechanism includes a plurality of coils. The bound component further includes a sell tag including at least one opening, the at least one opening receiving at least one coil of the binding mechanism therethrough, wherein the sell tag includes a flap which is folded about part of the outer perimeter of the cover.

In another embodiment the invention is a bound component including a generally flat, planar cover having first and second opposed sides. The bound component further includes a plurality of pages and a binding mechanism binding the cover and the plurality of pages together, wherein the binding mechanism includes a plurality of coils. The bound component has a sell tag having a first portion and a second portion directly coupled together, each portion including at least one opening, each opening receiving at least one coil of the binding mechanism therethrough, wherein the first portion is located on the first side of the cover and the second portion is located on the second side of the cover.

DETAILED DESCRIPTION

Figure 1:
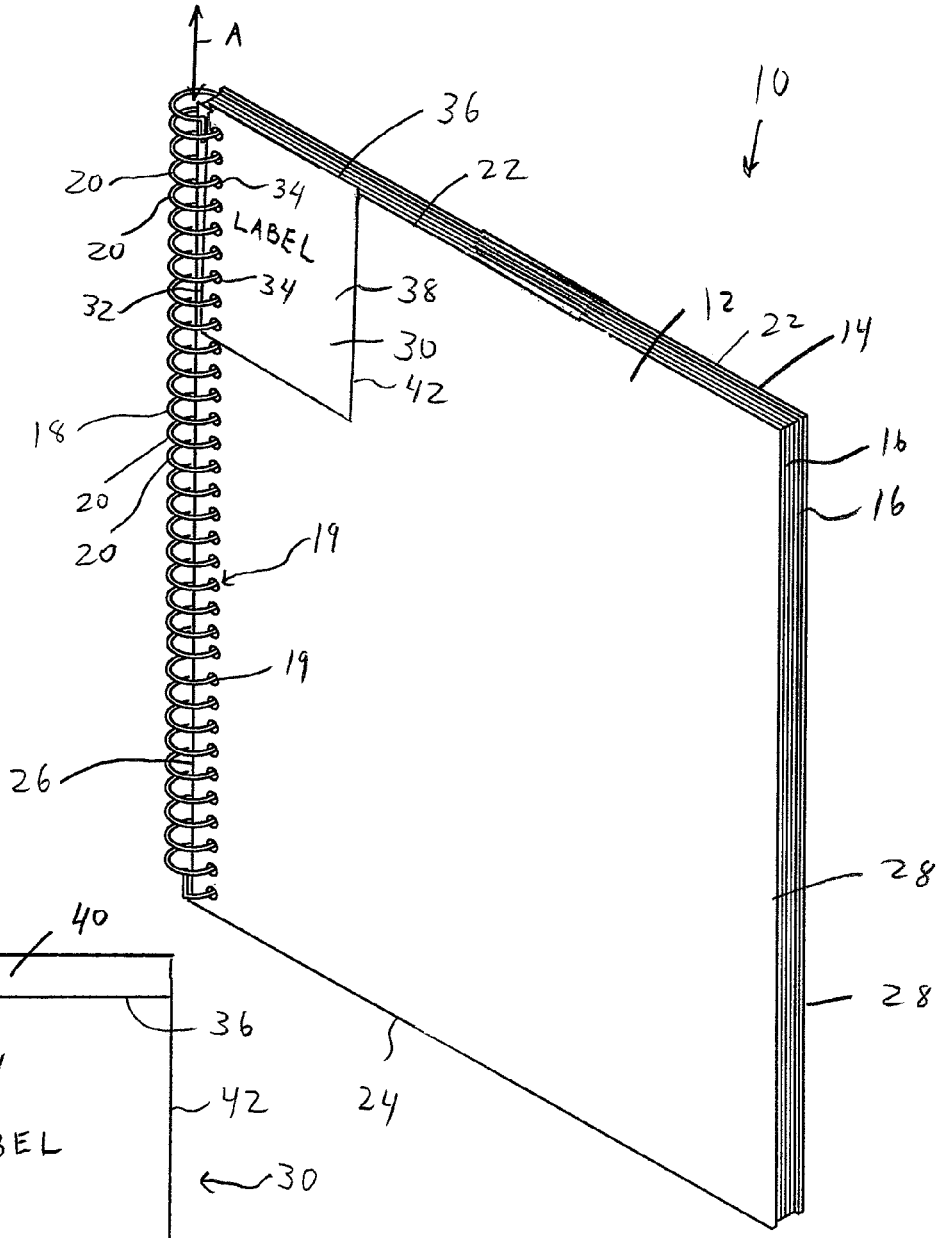
FIG. 1 is a front perspective view of a bound component in its closed position, with a sell tag coupled to the front cover thereof.

As shown in FIGS. 1 and 3-6, one embodiment the bound component 10 of the present invention includes a front cover

12, a rear cover 14 and a plurality of pages or sheets of paper 16 coupled together by a binding mechanism 18. In the illustrated embodiment, the binding mechanism 18 takes the form of a continuous wire binding mechanism, such as a coil wire, spiral wire or twin-wire binding mechanism. More particularly, the binding mechanism 18 may include a plurality of turns or coils 20 (collectively termed "coils" herein), each of which generally is circular in end view. Each coil 20 circumscribes a central axis extending along a length of an inner edge of the bound component 10. In this case, the binding mechanism 18 is generally cylindrical in shape. However, the binding mechanism 18 may take a variety of forms including a three-ring binding mechanism, various prongs, clips etc. which can pass through openings of the covers 12, 14/papers 16 and bind them together.

Each bound page 16 may be made of a generally water absorbent material, such as cellulose or pulp-based paper to allow a user to write information thereon with a wide variety of writing instruments or media including pens, pencils, markers and the like. The front 12 and rear 14 covers may each have a stiffness and/or a thickness greater than each of the bound pages 16 to provide protection to the pages 16. For example, the covers 12, 14 can be made of cardboard, paperboard, plastic, a combination of these materials, or the like. Each cover 12, 14 may include an outer perimeter having a top edge 22, a bottom edge 24, an inner or binding edge 26, and an outer or free edge 28.

Figure 3:
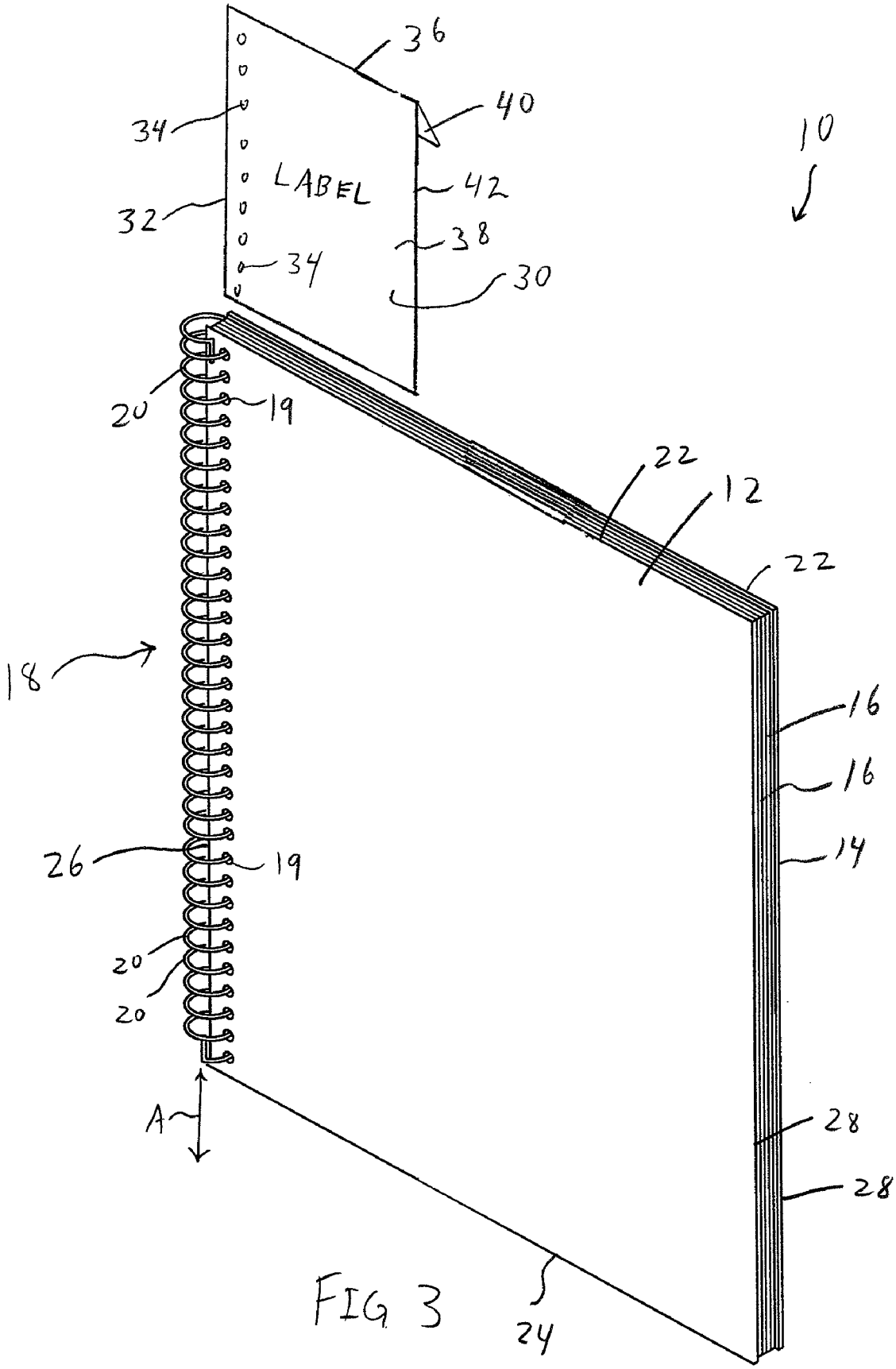
FIG. 3 is a front perspective view of the bound component of FIG. 1, with the sell tag exploded away from the bound component.
Figure 4:
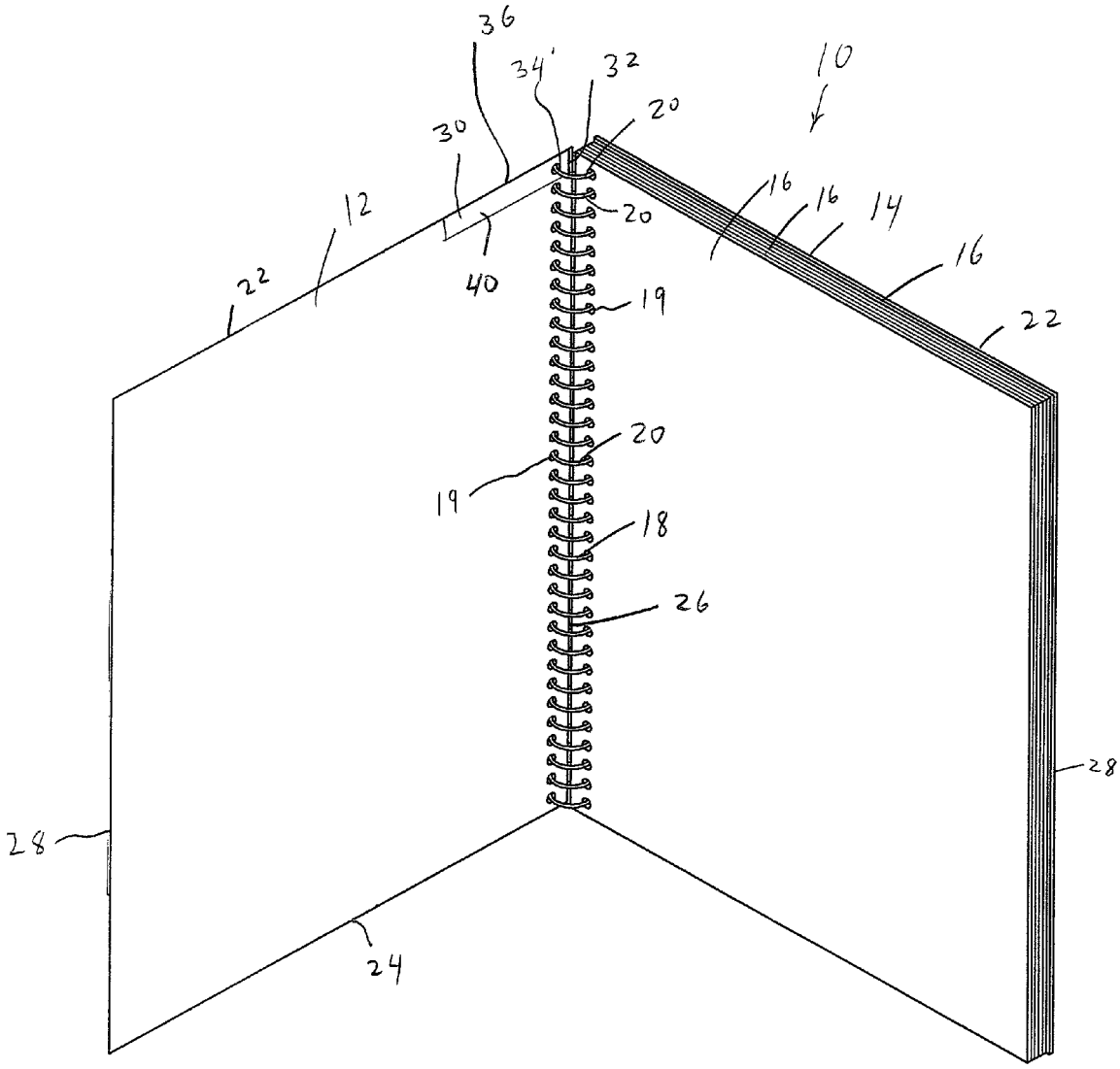
FIG. 4 is a front perspective view of the bound component of FIG. 1, shown in its open position.
Figure 5:
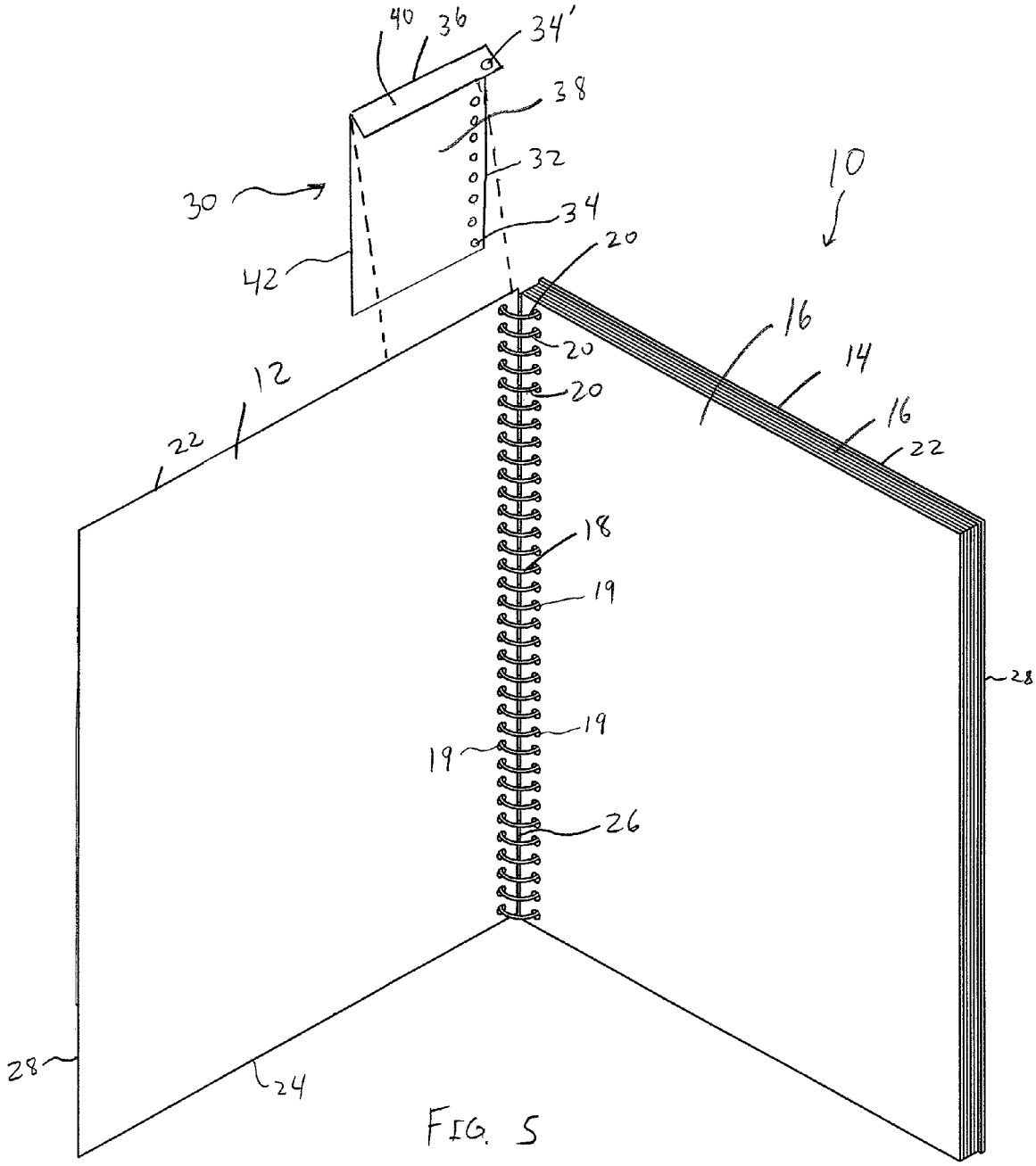
FIG. 5 is a front perspective view of the bound component of FIG. 4, with the sell tag exploded away from the bound component.
Figure 6:
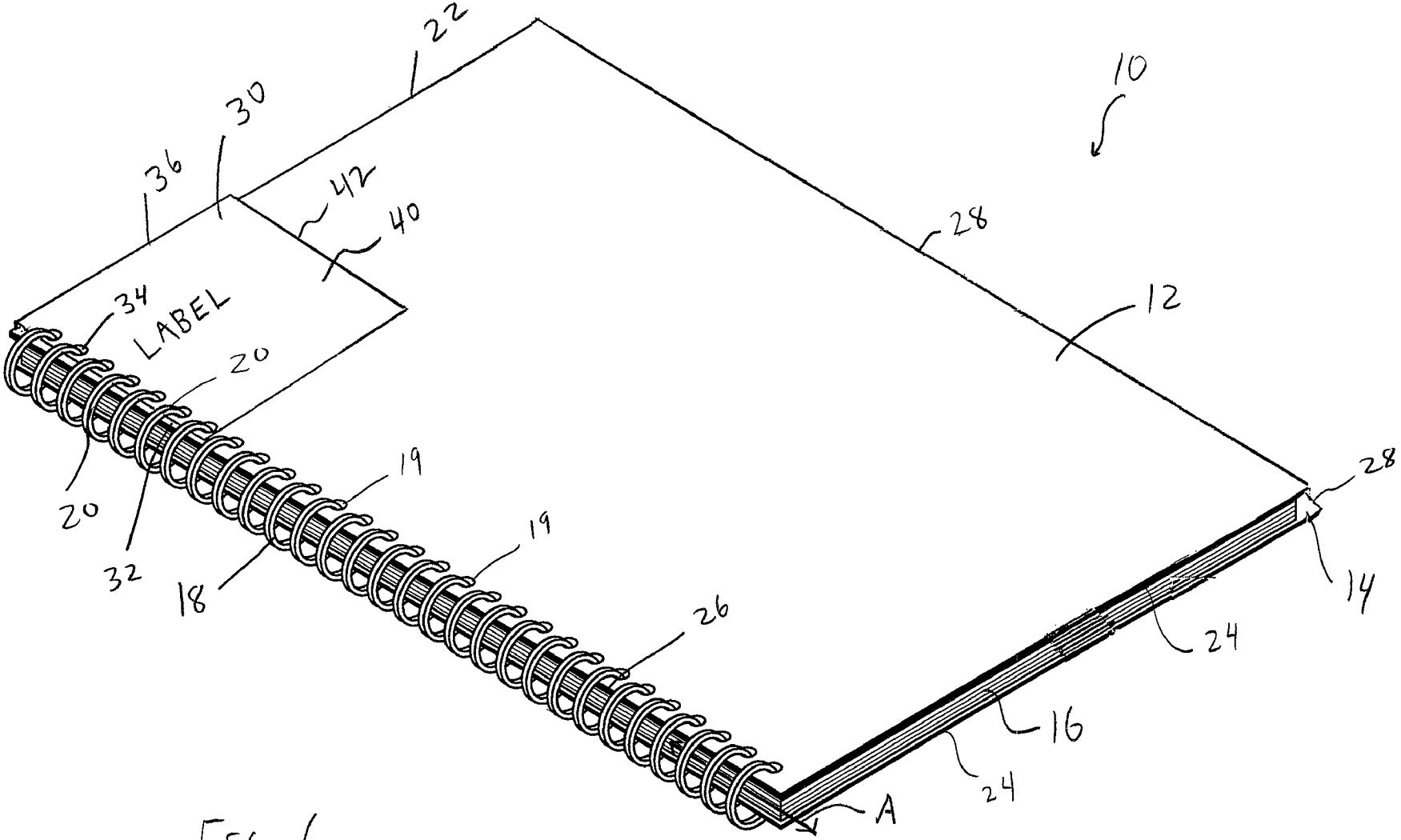
FIG. 6 is a front perspective view of another bound component with a sell tag coupled to the front cover thereof.

The bound component 10 is moveable between a closed position, as shown in FIGS. 1, 3 and 6, wherein the papers 16 are positioned between the covers 12, 14 in a thickness direction of the bound component 10, and a open position, as shown in FIGS. 4 and 5, wherein the papers 16 are not positioned between the covers 12, 14 in a thickness direction thereof. Each of the covers 12, 14 and pages 16 may include a plurality of openings 19 along their inner edges. Each opening 19 can receive a turn or coil 20 of the binding mechanism 18 therethrough to bind the covers 12, 14 and pages 16 together.

A sell tag or label 30 may be coupled to the bound component 10. The sell tag 30 may have various information or indicia pre-printed thereon relating to the bound component 10. For example, the sell tag 30 may display information relating to the features, nature or characteristics of the bound component 10, such as the number of pages, types of materials, dimensions, manufacturer information, pricing information, patent, trademark and copyright markings, UPC codes, description of product features, product name, decorative features, identifying information, country of manufacture, instructions or directions for use, contact and web-site information, marketing and advertising information and the like. The sell tag 30 can be made of a variety of materials, such as the same materials as the covers 12, 14 and/or papers 16 outlined above.

The sell tag 30 may be significantly smaller than the covers 12, 14 and/or pages 16 so as to not add unnecessary bulk and allow the notebook 10 to remain generally visible and available for inspection. Accordingly, the sell tag 30 may have a surface area, for example, of less than about ¼, or less than about ⅛, of the surface area of the covers 12, 14 or papers 16. The inner edge 32 of the sell tag 30 may be generally aligned with the inner edge 26 of the associated cover 12, 14/papers 16 to provide a neat appearance to the bound component 10. In one case, the inner edge 32 of the sell tag 30 is positioned within a distance of about ½ of the width (i.e. left-to-right direction) of the binding mechanism 18 of the inner edge 26 of the bound component 10, which provides a neat appearance and sufficient alignment to ensure that the sell tag 30 does not interfere with the binding mechanism 18, yet is sufficiently coupled to the binding mechanism 18.

The sell tag 30 may include a plurality of openings 34 extending along the inner edge 32. Each of the openings 34 may be sized and positioned to receive a turn or coil 20 of the binding mechanism 18 therethrough. Each opening 34 of the sell tag 30 may be aligned with an opening 19 of the associated cover 12, 14 and papers 16. In this manner, the openings 19/34 and the coils 20 cooperate to fixedly couple the sell tag 30 to the binding mechanism 18/front cover 12/bound component 10. The sell tag 30 can be bound to the binding mechanism 18 at the same time that the papers 16 and covers 12, 14 are bound together, or alternately the sell tag 30 could be bound to the binding mechanism 18 separately. As shown in FIG. 6, when the binding mechanism 18 is a twin-wire binding mechanism 18, each opening 19/34 may receive a pair of turns or coils 20 therethrough.

The sell tag 30 includes a fold line 36 that extends generally perpendicular to the binding mechanism 18 and divides the sell tag 30 into a body portion 38 and a flap 40. The sell tag 30 may be positioned such that the fold line 36 is generally aligned with the top edge 22 of the front cover 12 such that the sell tag 30 is folded over part of the perimeter of the cover 12. The folded flap 40 of the sell tag 30 may be positioned generally parallel to the body portion 38 and helps to further retain and align the sell tag 30 and further couple the sell tag 30 to the binding mechanism 18/cover 12/bound component 10. More particularly, if a sell tag 30 were to be bound to the binding mechanism 18 only by the openings 34, the outer edge 42 of the sell tag 30 may tend to drop or "sag" downwardly away from the top edge 22 of cover 12. However, when the flap 40 is folded about the front cover 12, the flap 40 helps to prevent the sell tag 30 from being pulled downwardly or sagging, and thereby keeps the sell tag 30 in a consistent aligned position. In this manner, the sell tag 30 is self-aligning and self-retaining in the desired position. Keeping the sell tag 30 consistently aligned provides a neater and more consistent appearance for the bound component 10, and helps to prevent inadvertent removal, tearing, or partial tearing of the sell tag 30

Figure 2:
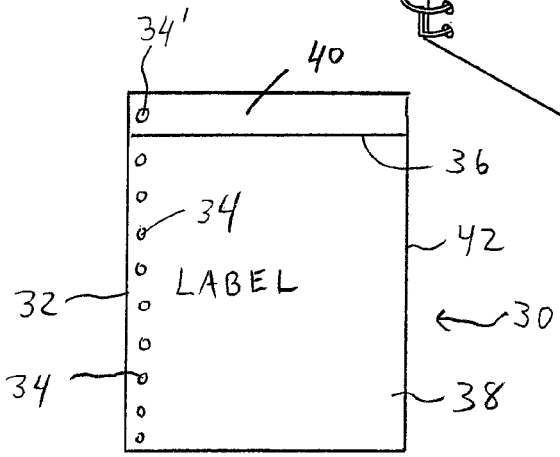
FIG. 2 is a front view of the sell tag of FIG. 1 removed from the bound component and laid flat.

If desired, as best shown in FIGS. 2, 4 and 5, the flap 40 may include an opening 34' formed therethrough to receive a turn/coil/coils 20 of the binding mechanism 18 therethrough. In this arrangement, the opening 34' helps to further securely couple the sell tag 30 to the cover 12/binding mechanism 18/bound component 10, and also helps to ensure that the flap 40 remains folded down against the inner surface of the cover 12. In this manner, the flap 40 is prevented from being flipped upwardly which could cause the flap 40/sell tag 30 to have an unattractive appearance, be snagged upon other components, and could reduce the ability of the sell tag 30 to be self-retaining and self-aligning. Thus the sell tag 30 may be located in the same, consistent position which provides ease of manufacturing, display and the like, and also helps to provide a consistent appearance to the bound component 10.

It should be understood that although the flap 40 is illustrated as being relatively short and having only a single opening 34', the flap 40 can be relatively long, even being as long or longer than the body portion 38 of the sell tag 30. In addition, the flap 40 can have more than one opening 34' to further secure the flap 40 to the binding mechanism 18//cover 12/bound component 10.

Although the sell tag 30 is illustrated as being positioned such that its flap 40 is folded over the upper edge 22 of the cover 12, the sell tag 30 could be positioned such that the flap 40 is also, or instead, folded over the lower edge 24 of the front cover 12, or even the outer edge 28 of the cover 12. The sell tag 30 could also or instead be coupled to the rear cover 14, or even to the pages 16.

Having described the invention in detail and by reference to the various embodiments, it should be understood that modifications and variations thereof are possible without departing from the scope of the invention.

What is claimed is:

1. A bound component comprising:

a cover having an outer perimeter;

a plurality of pages;

a binding mechanism binding said cover and said plurality of pages together, wherein said binding mechanism extends along a binding axis and includes a plurality of coils; and a sell tag including a body portion with a plurality of openings, each of said openings receiving at least one coil of said binding mechanism therethrough, and a flap foldably attached to said body portion along a folded line perpendicular to said binding axis, the flap being located between the cover and the plurality of pages and the body portion being located outside the cover, the flap including at least one opening receiving at least one coil of said binding mechanism therethrough, wherein part of said outer perimeter of said cover is located between said flap and said body portion.

2. The bound component of claim 1, wherein said plurality of openings extend along an inner edge thereof, each opening receiving at least one coil of said binding mechanism therethrough.

3. The bound component of claim 2 wherein said flap includes an opening receiving at least one coil of said binding mechanism therethrough.

4. The bound component of claim 3 wherein said folded line divides said sell tag into said flap and said body portion, and wherein said opening of said flap is generally aligned with one of said openings of said body portion.

5. The bound component of claim 1 wherein said folded line divides said sell tag into said flap and said body portion, and wherein said body portion is located on an outer surface of said cover, and said flap is located on an opposite, inner surface of said cover.

6. The bound component of claim 5 wherein said fold line extends generally perpendicular to said binding mechanism.

7. The bound component of claim 1 wherein said part of said outer perimeter of said cover about which said flap is folded extends generally perpendicular to said binding mechanism.

8. The bound component of claim 1 wherein said sell tag displays information relating to the features, nature or characteristics of the bound component.

9. The bound component of claim 1 wherein the sell tag has surface area of less than about ¼ of the surface area of said cover.

10. The bound component of claim 1 wherein said cover has an inner edge positioned adjacent to and extending along said binding mechanism, and wherein said sell tag has an inner edge positioned adjacent to and extending along said binding mechanism.

11. The bound component of claim 1 wherein said inner edge of said sell tag is generally aligned with said inner edge of said cover.

12. The bound component of claim 11 wherein said inner edge of said sell tag is positioned within about ½ inch of said inner edge of said cover.

13. The bound component of claim 1 wherein said binding mechanism is a coil, spiral, or twin-wire binding mechanism.

14. The bound component of claim 1 wherein said cover has at least one of a stiffness or thickness that is greater than each page of said plurality of pages.

15. A bound component comprising:

a generally flat, planar cover having first and second opposed sides and a bound edge;

a plurality of pages;

a binding mechanism binding said cover and said plurality of pages together along said bound edge, wherein said binding mechanism includes a plurality of coils; and a sell tag having a first portion and a second portion directly coupled together along a folded line, each portion including at least one opening, each opening receiving at least one coil of said binding mechanism therethrough, wherein said first portion is located on said first side of said cover and said second portion is located on said second side of said cover, and said folded line is perpendicular to said bound edge.

16. The bound component of claim 15 wherein said first and second portions of said sell tag are separated by said folded line.

17. The bound component of claim 16 wherein said cover has an outer perimeter, and wherein said folded line is generally aligned with part of said outer perimeter.

18. The bound component of claim 15, wherein said first and second portions are generally parallel to each other.

19. A method for assembling bound component comprising:

providing an outer cover having an outer perimeter;

providing a plurality of pages;

binding said outer cover and said plurality of pages together along a bound edge with a binding mechanism including a plurality of coils; and coupling a sell tag to said binding mechanism, said sell tag including a plurality of openings, each opening receiving at least one coil of said binding mechanism therethrough, wherein the sell tag includes a body portion and a flap which is folded about part of said outer perimeter of said outer cover along a folded line perpendicular to said bound edge to a position where said outer cover is located between said flap and said body portion wherein said body portion and said flap each include at least one of said openings.

20. The method of claim 19 wherein said coupling step occurs simultaneously with at least part of said binding step.

21. A bound component comprising:

A cover having an outer perimeter;

a plurality of pages;

a binding mechanism binding said outer and said plurality of pages together, wherein said binding mechanism extends along a binding axis and includes a plurality of coils; and a sell tag including a body portion with an inner edge adjacent said binding mechanism and with at least one opening along the inner edge, said at least one opening receiving at least one coil of said binding mechanism therethrough, wherein the sell tag includes a flap foldably attached to said body portion along a folded line perpendicular to said binding axis, the flap including at least one opening receiving at least one coil of said binding mechanism therethrough, the flap being located between the cover and the plurality of pages when the bound component is in a closed position, and the body portion being located outside the cover when the bound component is in a closed position, wherein part of said outer perimeter of said cover is located between said flap and said body portion.

* * * * *